United States Patent [19]

Leupold et al.

[11] Patent Number: 4,829,276

[45] Date of Patent: May 9, 1989

[54] OPTIMAL PERIODIC PERMANENT MAGNET STRUCTURE FOR ELECTRON BEAM FOCUSING TUBES

[75] Inventors: Herbert A. Leupold, Eatontown; Arthur Tauber, Elberon, both of N.J.

[73] Assignee: The United States of America as represented by the Secretary of the Army, Washington, D.C.

[21] Appl. No.: 41,258

[22] Filed: Mar. 30, 1987

[51] Int. Cl.[4] ..... H01F 7/00

[52] U.S. Cl. ..... 335/306; 335/210; 315/51.6; 315/5.35; 313/156

[58] Field of Search ..... 335/304, 306, 210; 315/5.13, 5.26; 313/156, 157

[56] References Cited

U.S. PATENT DOCUMENTS 3,129,356 4/1964 Phillips ..... 313/156

3,768,054 10/1973 Wendell ..... 335/304

4,592,889 6/1986 Leupold et al. ..... 419/66

*Primary Examiner*—Thomas H. Tarcza

*Assistant Examiner*—David Cain

*Attorney, Agent, or Firm*—Sheldon Kanars; John K. Mullarney

[57] ABSTRACT

In the preferred embodiment a plurality of toroidally shaped magnets of similar size and configuraton are placed in a stack side-by-side in coaxial alignment. Alternate magnets in the stack are magnetized so that the magnetic dipole moment of each is oriented in the radial direction. An axial magnetized toroidal magnet is disposed between each pair of adjacent radially magnetized magnets. The magnetic orientation of the successive toroidal magnets of the stack rotates continually in one direction in increments of 90° or $\pi/2$ radians from the magnet at one end of the stack to that at the other end.

8 Claims, 2 Drawing Sheets

OPTIMAL PERIODIC PERMANENT MAGNET STRUCTURE FOR ELECTRON BEAM FOCUSING TUBES

The invention described herein may be manufactured, used, and licensed by or for the Government for governmental purposes without the payment to us of any royalties thereon.

TECHNICAL FIELD

The present invention generally relates to microwave devices (e.g. traveling wave tubes—TWTs) in the millimeter wave region and, more particularly, to electron tube devices containing periodic permanent magnet (PPM) stacks.

BACKGROUND OF THE INVENTION

With the recent expansion of the military device spectrum into the millimeter wave region, a need has arisen for TWTs with unprecedently small bores, large energy products [greater than 30 megagauss-oersteds] and high intrinsic coercivities (greater than 12 kilo-oersteds). The foregoing considerations plus others have mitigated against the previously used Alnico-type magnets, and for the rare earth-cobalt (RECo) type magnets, particularly sumarium cobalt $SmCo_5$ and $Sm_2Co_{17}$ compositions. Also, differing magnetic configurations have been used in attempts to optimize the magnetic properties of the device(s).

Prior PPM stacks for lower frequency devices have used Alnico magnets of either axial or radial magnetic orientation to good effect. The reduction in size demanded by the designer of millimeter wave devices has, until recently, required the use of RECo magnets which are manufactured with only an axial magnetic orientation and alternated with pole pieces to conduct flux into the bore. This has led to extremely inefficient PPM stacks wherein the volume of the PPM stack bore was 1/20th of the total magnet material; a a 1-to-1 volume to bore ratio is considered in the range of optimum. A relatively new process for producing RECo magnets, called hot-isostatic-pressing process (HIP), has enabled them to be made very small and with a radial magnetic orientation which would not, by reason of stress cracks, fly apart upon release from its mold. A hybrid arrangement of axial and radial magnets is taught in U.S. Pat. No. 3,768,054 to W. Neugebauer. This device makes use of iron shells, pole pieces and large, unused, interior volumes: Further, the radially oriented magnets are arranged to surround the axially oriented magnets thus not leading to a teaching of the instant invention.

A growing need for extremely light-weight radars such as in remotely piloted vehicles (RPVs) has caused researchers to look to shorter and shorter wavelengths in order to solve their space and weight problems. However, existing amplifier tubes using Alnico magnets are not amenable to modification for small bores and short period magnetic circuits. They lack high coercivity and anisotropy necessary for direct contact PPM stacks. Fortunately, RECo magnets have these qualities and are almost immune to demagnetization and to change in magnetic orientation. Therefore, the problem existing in the art has been optimizing the design that will fulfill all the requirements.

SUMMARY OF THE INVENTION

It is the primary object of the present invention to achieve a periodic permanent magnet structure of substantially reduced size, weight and volume without the loss of axial field strength.

A related object is to achieve a significant cost reduction without affecting the performance of periodic permanent magnet structures useful in the field of electron beam focusing tubes.

The above and other objects are achieved in accordance with a preferred embodiment of the present invention wherein a plurality of toroidally shaped magnets of similar size and configuration are placed in a stack side-by-side in coaxial alignment. Alternate magnets in the stack are magnetized so that the magnetic dipole moment of each is oriented in a radial direction. An axially magnetized toroidal magnet is disposed between each pair of adjacent radially magnetized magnets. The magnetic orientation of the successive toroidal magnets of the stack rotates continually in one direction in increments of 90° or $\pi/2$ radians from the magnet at one end of the stack to that at the other end.

BRIEF DESCRIPTION OF THE DRAWINGS

The invention will be more fully appreciated from the following detailed description when the same is considered in connection with the accompanying drawings, in which.

DETAILED DESCRIPTION

Figure 1:
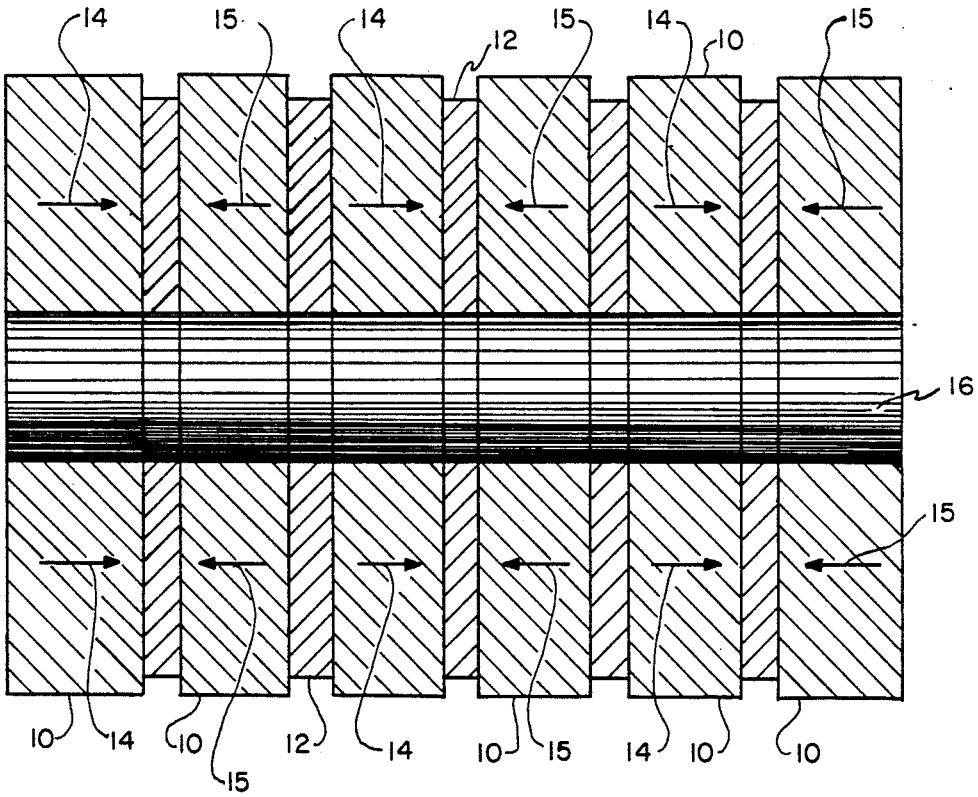
FIG. 1 (PRIOR ART)
FIG. 1 is a longitudinal cross-section of a prior art PPM stack.

FIG. 1 illustrates a known prior art periodic permanent magnet (PPM) stack. Toroidal magnets 10 act as flux sources and have magnetic dipole moments 14 and 15 oriented in the axial direction. The axial magnetic dipole moment is in a direction indicated by arrows 14 and 15. The heads of the arrows 14 and 15 point in the direction of the north pole of the magnets 10. The magnets 10 are stacked end to end so that their magnetic dipole moments represented by arrows 14 and 15 alternate in the axial direction. Between the magnets 10, iron pole pieces 12 are used to conduct magnetic flux into the bore 16 of the PPM stack. The volume of magnetic material needed to create the desired magnetic field within bore 16 is much greater than that required in the configuration of the present invention.

Figure 2:
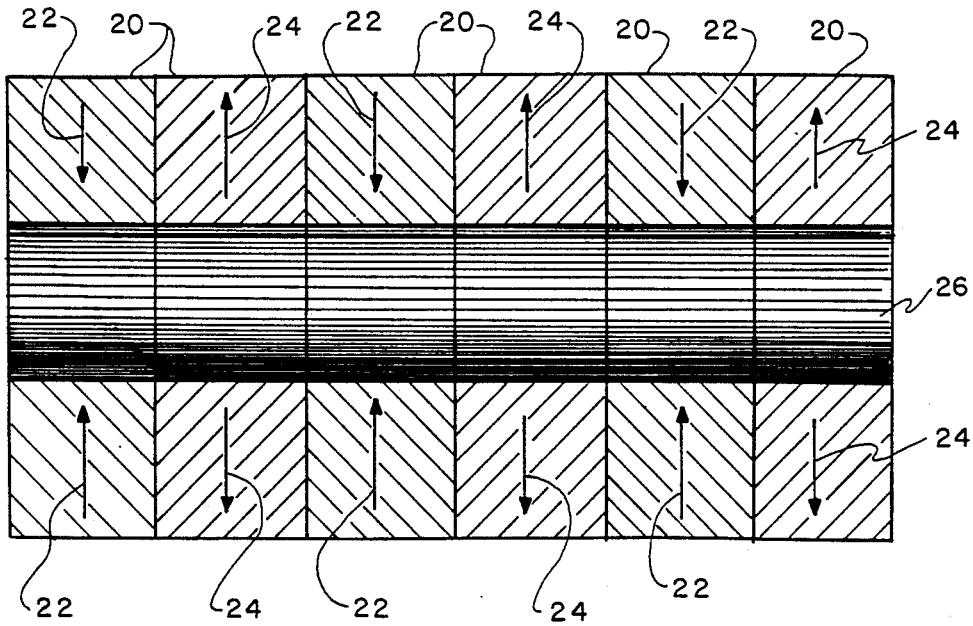
FIG. 2 is a longitudinal cross-section of a PPM stack in accordance with the present invention.

FIG. 2 illustrates an embodiment of the present invention. Toroidally shaped magnets 20 are stacked coaxially end to end forming a cylinder having a bore 26. Toroidal magnets 20 are radially magnetized and each has a magnetic dipole moment oriented in the radial direction. The direction of the radial magnetic dipole moments are represented by arrows 22 and 24. The head of the arrows 22 and 24 point in the direction of the north pole of the toroidal magnets 20. Arrows 24 represents the magnetic dipole moment of toroidally shaped magnets 20 pointing in a direction radially outward. Arrows 22 represents the magnetic dipole moment of toroidally shaped magnets 20 extending radially inward. The toroidally shaped magnets 20 are stacked coaxially end to end so that the directions of their magnetic dipole moments alternate from extending radially inward and radially outward while progressing longitudinally along the PPM stack. The volume of magnetic material needed to produce the same magnetic field within the same bore as the prior art is substantially less.

Figure 3:
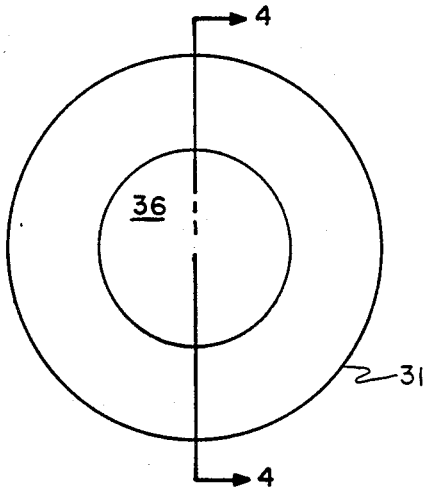
FIG. 3 is an end view of a PPM stack of the invention.

FIG. 3 is an end view of a PPM stack of the present invention. Toroidally shaped magnets 31 are coaxially stacked end to end forming a cylinder having a cylindrical bore 36. The individual toroidally shaped magnets 31 can be assembled together by any known conventional means.

Figure 4:
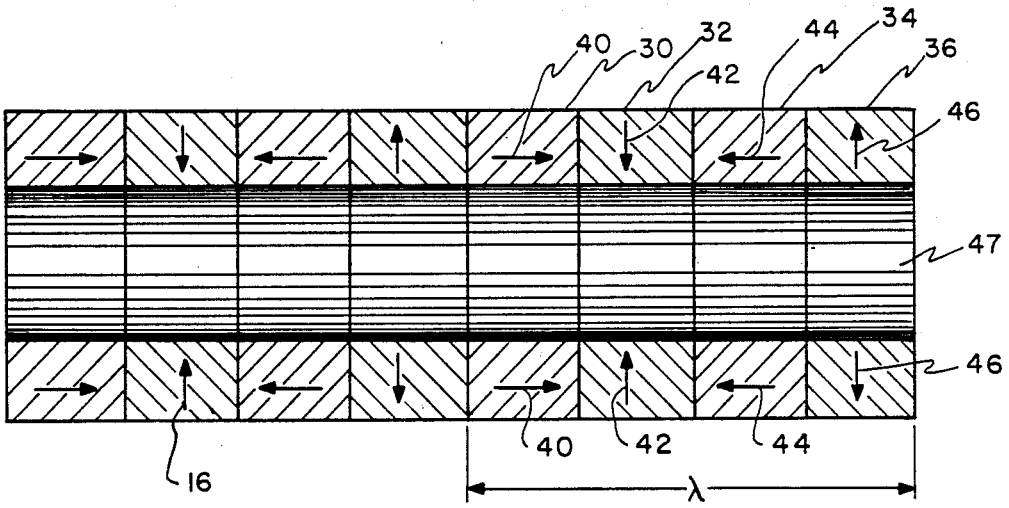
FIG. 4 is a longitudinal cross-sectional view of a PPM stack in accordance with the preferred embodiment of the invention.

FIG. 4 is a longitudinal cross-section of the preferred embodiment of the invention. Arrows 40, 42, 44, and 46 represent the direction of the magnetic dipole moment corresponding to each of the toroidally shaped magnets 30, 32, 34, and 36. Magnets 30, 32, 34, and 36 form one period $\lambda$ of the PPM stack. The magnetic dipole moments 40, 42, 44, and 46 each rotate 90° or $\pi/2$ radians in a uniform direction while progressing longitudially along the PPM stack. THe PPM stack is comprised of a plurality of periods $\lambda$ depending upon the application. Toroidally shaped magnet 30 has a magnetic dipole moment in the axial direction represented by arrow 40. Toroidally shaped magnet 32 is positioned adjacent toroidally shaped magnet 30. Magnet 32 has a magnetic dipole moment in the radial direction represented by arrow 42. Because the magnetic dipole moment represented by arrow 42 has its north pole on the inner or smaller circumference of toroidally shaped magnet 32 it can be said to be extending radially inward. Toroidally shaped magnet 34 is positioned adjacent magnet 32. Magnet 34 has a magnetic dipole amount represented by arrow 44 in the axial direction. The magnetic dipole moment of magnet 34 represented by arrow 44 is in a direction opposite to that of the magnetic dipole moment of magnet 30 represented by arrow 40. Toroidally shaped magnet 36 is positioned adjacent magnet 34 and has a magnetic dipole moment represented by arrow 46 in the radial direction. Because the north pole of toroidally shaped magnet 36 is located on the outer or larger circumference the magnetic dipole moment represented by arrow 46 can be said to extend radially outward.

The devices in FIGS. 1–4 all create an axial periodic magnetic field within their bores. In FIG. 1 a periodic axial magnetic field is created in bore 16 by the alternating axial magnetic dipole moments of magnets 10 represented by arrows 14 and 15. In FIG. 2 the same strength periodic axial magnetic field can be created in bore 26 with substantially less volume of magnetic material. The periodic axial magnetic field within bore 26 is created by toroidally shaped radial magnets 20 that have magnet dipole moments represented by arrows 22 and 24 that alternate from extending radially inward to radially outward. In FIG. 4, the preferred embodiment, the same strength axial periodic magnetic field can be created in bore 47 as that created in an equal size bore 26, in FIG. 2, or an equal size bore 16, in FIG. 1. The preferred embodiment of FIG. 4 can create this equal strength axial periodic magnetic field with substantially less volume of magnetic material than that necessary in the devices of FIG. 1 and FIG. 2. Therefore, a charged particle, typically an electron beam, can be focused within bore 46 with the use of substantially less magnetic material as that required in either configuration shown in FIG. 1 or FIG. 2.

Figure 5:
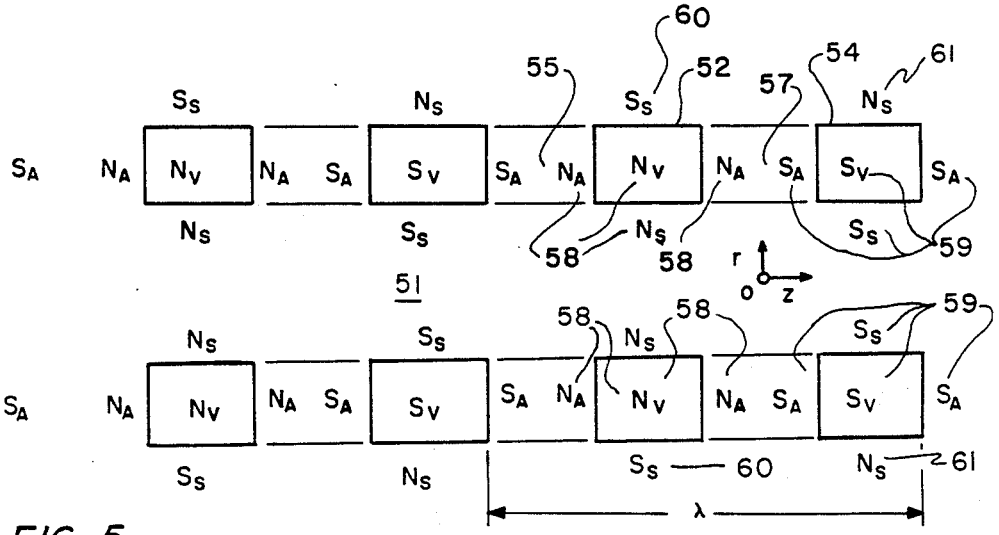
FIG. 5 is a schematic representation of a portion of the FIG. 4 embodiment.

FIG. 5 is a schematic representation of a portion of a PPM stack in accordance with the preferred embodiment of the present invention. FIG. 5 illustrates the volume (Nv and Sv) and surface (Ns, Ss, Na, Sa) poles of the toroidally shaped magnets illustrated in FIG. 4. Reference numeral 51 designates the longitudinal bore. Squares 52 and 54 represent radially inward and outward magnetized toroidally shaped magnets, respectively (e.g., 32 and 36 of FIG. 4). Spaces 55 and 57 between the squares represent the axially magnetized toroidally shaped magnets (e.g., 30 and 34 of FIG. 4). In FIG. 5, Ns and Ss represent the north and south surface poles of the radially oriented toroidal magnets. Na and Sa represent the north surface and south surface poles of the axially magnetized toroidally shaped magnets. Sv and Nv represent respectively the south volume pole distributions and the north volume pole distributions of the radially magnetized toroid magnets.

A general, functional understanding of the invention can be had by assuming a "magnetic mono-pole" at point zero (0). The r direction represents the radial direction and the z direction represents the axial direction. A magnetic mono-pole or pole at point zero will experience a force due to the combined effect of all the surface poles and volume poles of the toroidally shaped magnets. The north poles designated by the reference numeral 58 in FIG. 5 create a magnetic force that tends to move the pole at point zero to the right. At the same time, the south poles designated by the reference numeral 59 have the cumulative effect to create a magnetic force which pulls the pole at point zero to the right. Thus, there is a cumulative north pole magnet force (58) pushing to the right and the designated south poles (59) pulling to the right with the combined effect that there is a strong cumulative magnetic force moving the pole at point zero to the right. In contrast, the south poles 60 and the north poles 61 set up a counter magnetic force at point zero which would have a tendency to move the pole at point zero to the left. However, it will be evident to those skilled in the art that the magnetic force created by these latter south and north poles (60, 61) is substantially less than the previously discussed magnetic forces created by the north and south poles, 58 & 59. As a consequence, there is clearly a very substantial net resultant force on the magnetic monopole at point zero to the right.

The additional non-referenced squares and spaces of FIG. 5 do, in fact, also exert a magnetic force on the pole at point zero; but, because they are a distance removed from point zero the magnetic force exerted by the same on the pole at point zero is, for present purposes, negligible and can be disregarded.

Now the difficulty in obtaining radially oriented rare earth permanent magnets (REPM's) has hampered the design of efficient configurations for many applications. Microcracks arising from the sintering procedure used in the fabrication of $SmCo_5$ magnets cause the toroids to break apart under the stresses engendered by radial magnetization. Formation of radial $SmCo_5$ magnets by the hot-isostatic-pressing process (HIP) appears to overcome this problem as it produces relatively homogenous magnets without microcracks. Prototype radial magnets (FIG. 2) fashioned in this manner have exhibited remanences of 8.5 kG which is within the range of values displayed by sintered commercial magnets of conventional orientation. Thus, the advent of HIP may well revolutionize magnetic design since it permits the use of the high-energy product rare earths in applications where relatively high fields must be produced by permanent magnets of unconventional shape and magnetically unfavorable aspect ratio.

Each of the radially oriented magnets in the configuration of FIG. 2 will have poles of opposite polarity on its inner and outer surfaces. The surface pole density for radial magnetization is given by $$\sigma=\vec{M}\cdot n=M, \tag{1}$$

where $\vec{M}$ is the magnetization vector and n the unit vector normal to the surface element at which $\sigma$ is to be evaluated. In addition, there is a volume pole density arising from a nonvanishing divergence of the magnetization of a radially magnetized toroid. The density of volume poles is given by $$\rho = -\vec{\nabla}\cdot\vec{M} = -\frac{1}{n}\frac{\partial(nM)}{\partial n} = -\frac{M}{n} \tag{2}$$

The poles produce a field at point 0 in accordance with the Coulomb inverse square law. Because the charge distribution has cylindrical symmetry, the radial components of the fields produced by the individual poles cancel and we are left with an axial field that is equal to the sum of the component axial fields. The summation over the inner surface pole distribution of magnets is given by $$H_{is} = -\frac{4\pi MR_i}{(Z^2+R_i^2)^{\frac{1}{2}}}\Bigg|_c^w = 4\pi MR_i\,[R_i^{-1} - (w^2+R_i^2)^{-\frac{1}{2}}] \tag{3}$$

Similarly, for the field due to the outer surface we have $$H'_{os}=-4\pi MR_i[R_o^{-1}-((2w)^2+R_i^2)^{-\frac{1}{2}}]. \tag{4}$$

The minus sign occurs because the poles on the outer surface are of opposite polarity to those on the inner. Therefore, the axial field at the center of the stack due to surface poles is a sum over the fields due to the individual magnets viz., $$H_s = 4\pi MR_i\Bigg\{\sum_{n=1}^{N}(-1)^{n-1}[\{(n-1)^2w^2+R_i^2\}^{-\frac{1}{2}} - \{n^2w^2+R_i^2\}\ldots - \sum_{n=1}^{N}(-1)^{n-1}[\{(n-1)^2w^2+R_o^2\}^{-\frac{1}{2}} - \{n^2w^2+R_o^2\}^{-\frac{1}{2}}]\Bigg\} \tag{5}$$

where N is half the number of magnets in the stack.

A similar integration over the volume pole distribution yields the series $$Hv = 4\pi M\sum_{n=1}^{N}(-1)^{n-1}\Bigg|_n\Bigg\{\frac{R_i+[R_i^2+(n-1)^2w^2]^{\frac{1}{2}}}{R_o+[R_o^2+(n-1)^2w^2]^{\frac{1}{2}}}\cdot\frac{R_o+[R_o^2+n^2W^2]^{\frac{1}{2}}}{R_i+[R_i^2+n^2w^2]^{\frac{1}{2}}}\Bigg\} \tag{6}$$

and the total field at the center of the stack is $$H=H_v+H_s \tag{7}$$

for the radial configuration of FIG. 1

H=4.3 kOe if the calculation is made to the third order of the radial configuration.

The equivalent pole distribution for the hybrid of FIG. 4 is shown in FIG. 5. The inner and outer surface poles, as well as those distributed in the volume, are similar to those of the pure radial configuration with differences in the limits of integration due to the alternate interruption of the radial stack by axial magnets. The presence of the axial magnets in the hybrid case results in additional annular surface pole distributions, A, which also contribute to the field at 0. Integration over these areas results in the expression:

$$H_A = 4\pi M\sum_{n=0}^{N}(n+\tfrac{1}{2})(-1)^{n-1}w\,\{[(n+\tfrac{1}{2})^2w^2+R_i^2]^{\frac{1}{2}} - [(n+\tfrac{1}{2})^2w^2+R_o^2]^{-\frac{1}{2}}\} \tag{8}$$

so the expression for the field becomes $$H=H_s+H_v+H_A \tag{9}$$

which, for the configuration of FIG. 4, yields to the third order

H=4.1 kOe, or merely the same as the fourfold larger pure radial configuration of FIG. 2 and the fifteenfold larger axial configuration of FIG. 1.

The series obtained from matching cylindrical harmonics to the boundary conditions can be used for both FIGS. 2 and 4. It is $$H = \sum_{\sigma}^{\infty}[G(nX_1) - G(nX_2)]\frac{\sin(n\pi/M')}{n\pi/M'} \tag{10}$$

where $n=1+\sigma M'$; $X_1=kR_i$; $X_2=kR_o$, $k=2\pi/\lambda$; $\lambda$ is the period of the magnet stack; M' is the number of individual magnets in the period, $\lambda$, and $$G(x) = XK_1(X)_{1.0} + K_o(X) + \int_X^{\infty}K_o(X)dx$$

where the K's are modified Bessel functions.

The series (10) yields H=4.1 kOe within 1 term for configuration FIG. 4 and within 2 terms for FIG. 2, and so is seen to converge more rapidly than series 7 and 9. The two latter expressions, however, have the advantages of being exact, finite series and, with appropriate modification of summation and integration limits, applicable to any period of the stack. Expression (10) is an infinite series strictly applicable only to an infinitely long stack or to observation points at appreciable distances from the ends of long, finite stacks. Expression (10) is more general in that it applies to either FIG. 2 or 4, the difference in configuration being reflected by the insertion of different values of M'; 2 for FIG. 2, and 4 for FIG. 4. The insertion of large values of M' into (10) shows that the more continuous the change in orientation from magnet to magnet as one proceeds down the stack, the larger the field amplitude obtained on the axis. Therefore, the most efficient configuration would be for perfect continuity, that is, with $M'=\infty$. Such an arrangement would yield $H=4.6$ kOe for $R_o=1$ cm, or an increase of ten percent over that of the hybrid stack. At present, however, 4 is the largest value of M' that is technologically feasible.

What is claimed is:

1. A periodic permanent magnet (PPM) structure for the magnetic focusing of the electron beams of electron tube devices comprising a plurality of toroidally shaped permanent magnets of similar size and configuration, said magnets being in coaxial alignment, said magnets being radially magnetized so that the magnetic dipole moment of each is oriented in the radial direction, the magnetic dipole moments of said magnets continually alternating from a radial inward direction to a radial outward direction to a radial inward direction along the longitudinal axis of the stack of permanent magnets, and a toroidally shaped permanent magnet having an axially directed magnetic dipole moment diposed between each pair of adjacent radially magnetized permanent magnets.

2. A PPM structure as defined in claim 1 wherein the axially directed dipole moments continually alternates in direction along the longitudinal axis of the stack of permanent magnets.

3. A PPM structure as defined in claim 2 wherein the magnetic orientation of the successive toroidal magnets of the stack rotates continually in one direction in increments of $\pi/2$ radians from one end of the stack to the other.

4. A charged particle beam focusing structure comprising a plurality of similarly sized and shaped toroidal magnets each having a predetermined magnetic dipole moment, said magnets stacked coaxially side-by-side forming a tube so that the magnetic dipole moment of each of said magnets is transverse to each adjacent magnetic orientation.

5. A focusing structure as defined in claim 4 wherein the magnetic dipole moment of each of said magnets is substantially perpendicular to each adjacent magnetic dipole moment.

6. A focusing structure as defined in claim 5 wherein the magnetic dipole moment rotates evenly in 90° increments from one magnet to the next in the stack of magnets.

7. A focusing structure as defined in claim 4 wherein said magnets are formed of a samarium cobalt $SmCo_5$ or $Sm_2Co_{17}$ composition.

8. Apparatus for performing magnetic focusing of electron beams in traveling wave tubes and the like comprising:

a stack of substantially equally sized toroid shaped permanent magnets abutted end-to-end along their axis of symmetry, said stack comprising:

a first plurality of toroids having a magnetic orientation substantially colinear with the axis of symmetry; and a second plurality of toroids having a magnetic orientation which is radial with respect to said axis of symmetry, said first and second plurality of toroids being alternated with each other and arranged so that the magnetic orientation of the toroids within said stack rotates evenly in $\pi/2$ increments from one end of said stack to the other end.

* * * * *